US006664769B1

(12) United States Patent
Haas

(10) Patent No.: US 6,664,769 B1
(45) Date of Patent: Dec. 16, 2003

(54) VARIABLE AMPLITUDE REGULATOR

(76) Inventor: Richard Haas, 6203-104 Rime Vlg. Dr., Huntsville, AL (US) 35806

( * ) Notice: Subject to any disclaimer, the term of this patent is extended or adjusted under 35 U.S.C. 154(b) by 0 days.

(21) Appl. No.: 10/199,646

(22) Filed: Jul. 20, 2002

(51) Int. Cl.[7] ..... G05F 1/70
(52) U.S. Cl. ..... 323/207; 323/222
(58) Field of Search ..... 323/207, 205, 323/283, 282, 222

(56) References Cited

U.S. PATENT DOCUMENTS 5,461,301 A * 10/1995 Truong ..... 323/207
5,684,686 A * 11/1997 Reddy ..... 363/97

* cited by examiner

*Primary Examiner*—Shawn Riley
(74) *Attorney, Agent, or Firm*—LaValle D. Ptak

(57) ABSTRACT

Active power factor correction (PFC) circuits are used to minimize unwanted harmonic distortion in applications where AC electrical power is rectified to produce DC power needed for operating electrical equipment. A variable amplitude regulator (VAR) is a PFC control interface which is simpler to implement than conventional circuits, and offers a wider dynamic operating range. The VAR functions as a resistor scaling network using a two-stage RC filter to maintain the DC output voltage constant for various load conditions and to maintain the rectified current in phase with the sinusoidal circuit flow in an AC power line, through both slow and rapid changes in the load coupled to the direct current output. This control interface offers excellent performance characteristics and requires only a few components for a useful implementation.

15 Claims, 3 Drawing Sheets

VARIABLE AMPLITUDE REGULATOR

BACKGROUND

Power Factor Correction (PFC) circuits are used to minimize unwanted disturbances in AC power lines, and to provide a constant DC output voltage under all load conditions. The AC line disturbances are caused by normal operation of DC powered electrical equipment, and are exhibited as phase shift of the AC input current and distortion of the current waveform. The PFC minimizes the distortion and corrects the phase shift. Existing PFC control circuits are complex, difficult and time consuming to implement, and have a limited dynamic range. By incorporating a power factor correction circuit between the alternating current supply and the direct current supply connected to the load, however, harmonic distortion in the AC power line is reduced; and the operational characteristics of some electrical equipment is improved. It is desirable to provide an improved PFC control circuit which is simple, has a wide dynamic range and requires minimal expertise to implement using a variable Amplitude Regulator (VAR) to accomplish this by using simple resistive scaling, instead of complex multiply and divide circuit functions, to product the PFC control signal.

SUMMARY OF THE INVENTION

It is an object of this invention to provide an improved power factor correction (PFC) system.

It is another object of this invention to provide an improved variable amplitude regulator (VAR) signal interface in a switch-mode PFC system.

It is an additional object of this invention to provide an improved analog variable amplitude voltage regulator for use in a power factor correction system.

It is a further object of this invention to provide an improved variable amplitude voltage regulator (VAR) for use in a power factor correction system in which the VAR interface functions as a resistor scaling network utilizing at least one variable resistor for responding to a wide dynamic range of load variations.

In accordance with a preferred embodiment of the invention, a variable amplitude voltage regulator (VAR) utilized in a power factor correction system operates as a resistor scaling network. The network consists of at least one variable resistor R2 (a JFET) and three fixed resistors R1, R3 and R4. A source of rectified alternating current input voltage (ACR) is coupled to the resistor scaling network. The output of a voltage error differential amplifier (VES) is coupled through a filter to the gate of the JFET (R2). The amplitude of the VES controls the resistance value of R2 such that the scaling network produces a demand level control signal (DLS) for the power factor correction circuit in accordance with the following formula:

$$DLS = \left(\frac{R2}{R1 + R2}\right) \times \left(1 + \frac{R4}{R3}\right) \times ACR$$

wherein R2 varies as a function of the VES dc level.

DETAILED DESCRIPTION

Figure 1:
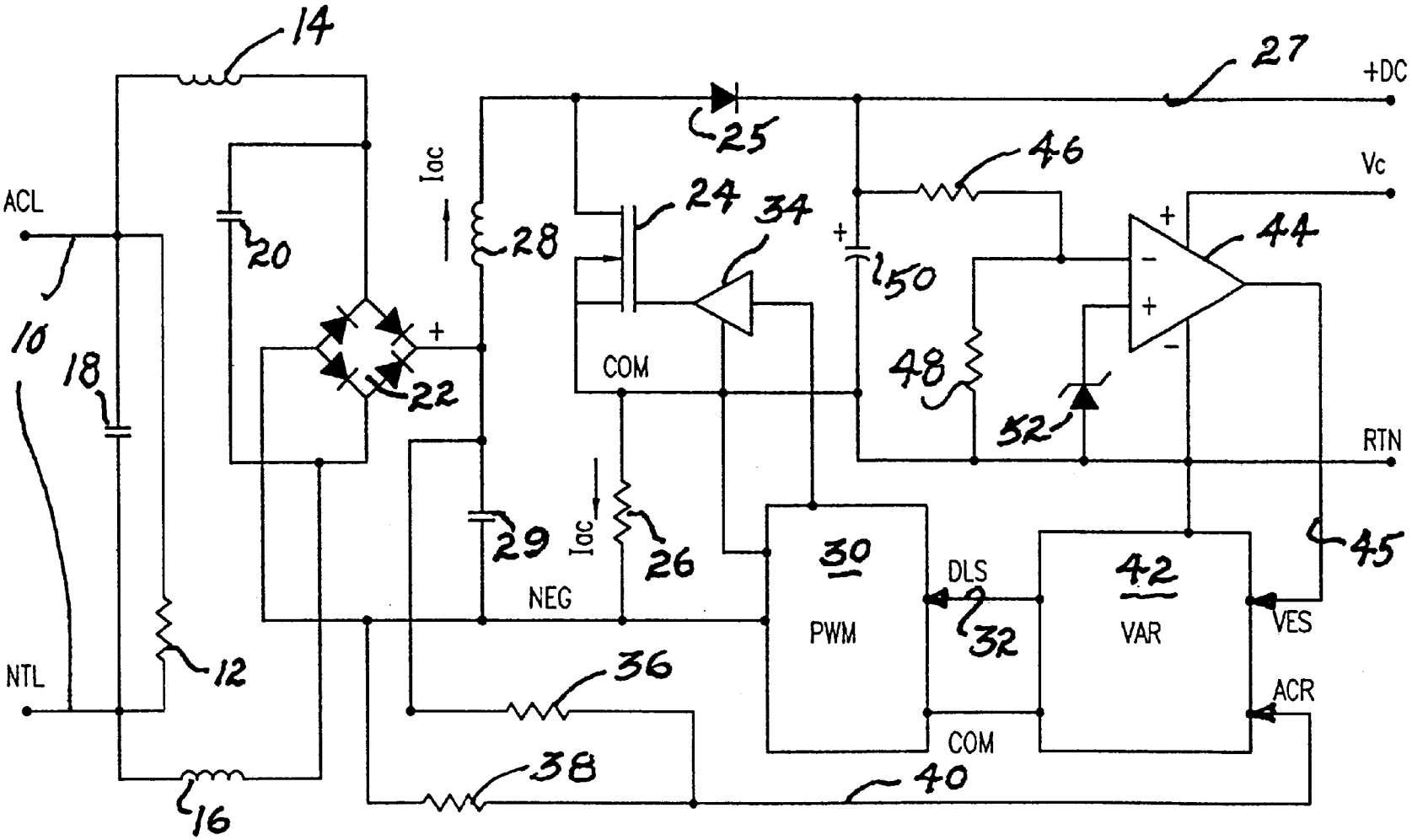
FIG. 1 is a schematic diagram of a power factor correction circuit incorporating a preferred embodiment of the invention.

Reference now should be made to the drawings, in which the same reference numbers are used throughout the different figures to designate the same or similar components. FIG. 1 is a schematic diagram of a switch-mode boost converter of a typical configuration, which is used for a power factor correction circuit. In the circuit of FIG. 1, the location and functional interconnections of a variable amplitude regulator interface (VAR) are illustrated.

In the circuit shown in FIG. 1, standard alternating current (AC) utility power is connected across the input terminals 10, also designated as ACL-NTL. Although a specific implementation of a switch-mode boost converter is illustrated in FIG. 1, other implementations may be used. The alternating current input voltage is filtered by a common mode choke consisting of a pair of independent windings 14, 16 and a pair of capacitors 18 and 20 interconnected in a convention manner across the AC input line 10. This filtered alternating current voltage is applied to a full wave bridge rectifier 22. The rectifier 22 output is connected to a switch-mode boost stage consisting of an inductor 28, a capacitor 29, a transistor (MOSFET) 24 and a resistor 26. The capacitor 29 is connected across the DC terminals of the rectifier 22; and the positive terminal of the rectifier 22 is connected through the inductor 28 and an additional diode 25 to the positive DC output load terminal 27. The negative or return terminal of the rectifier 22 is coupled to the lower side of the resistor 26, shown in FIG. 1. A large electrolytic capacitor 50 is placed across the DC output terminals to smooth the output voltage and current.

In order to achieve the desired sinusoidal current flow in the AC power line (see FIG. 2, top set of waveforms), it is necessary to regulate the current flow through the power inductor 28 in the switch-mode boost stage. At any instant in time, the magnitude of the current in the inductor 28 is equal to the absolute value of the alternating line current. This is indicated by the designation lac in FIG. 1. As is apparent from FIG. 1, this same current flows through the transistor 24 and the resistor 26, which are connected in series with the inductor 28 across the terminals of the rectifier 22. Regulation of this current through the inductor 28 and the resistor 26 is controlled by a pulse width modulation circuit (PWM) 30, used to adjust the on/off duty ratio of the MOSFET transistor 24.

The functional characteristics of pulse width modulation circuits, such as the circuit 30, are well understood and a detailed description of the operation of such a circuit is not considered necessary here. The PWM circuit 30 shown in FIG. 1 uses an average current-mode control method to regulate the current through the inductor 28,.as a function of the lac feedback current from the resistor 26 and of a demand level signal (DLS) 32 provided by a PFC control circuit. The output of the PWM circuit 30 connects through a driver 34 to the gate of the MOS FET 24 to modulate its on/off duty ratio in order to control current flow through the inductor.

Required inputs to the PFC control circuit are the AC rectified voltage signal (ACR) and the voltage error signal (VES). The ACR is generated through the resistor divider 36 and 38, and the VES is the output of the differential amplifier 44 on the lead 45. The PFC circuit causes the current waveform in the power inductor 28 to be congruent and in phase with the AC voltage waveform. It also responds to changes in load by adjusting the amplitude of the AC input current. In this new PFC circuit implementation which is illustrated in FIG. 1, the control functions needed for power factor corrections are provided by the VAR interface.

Figure 2:
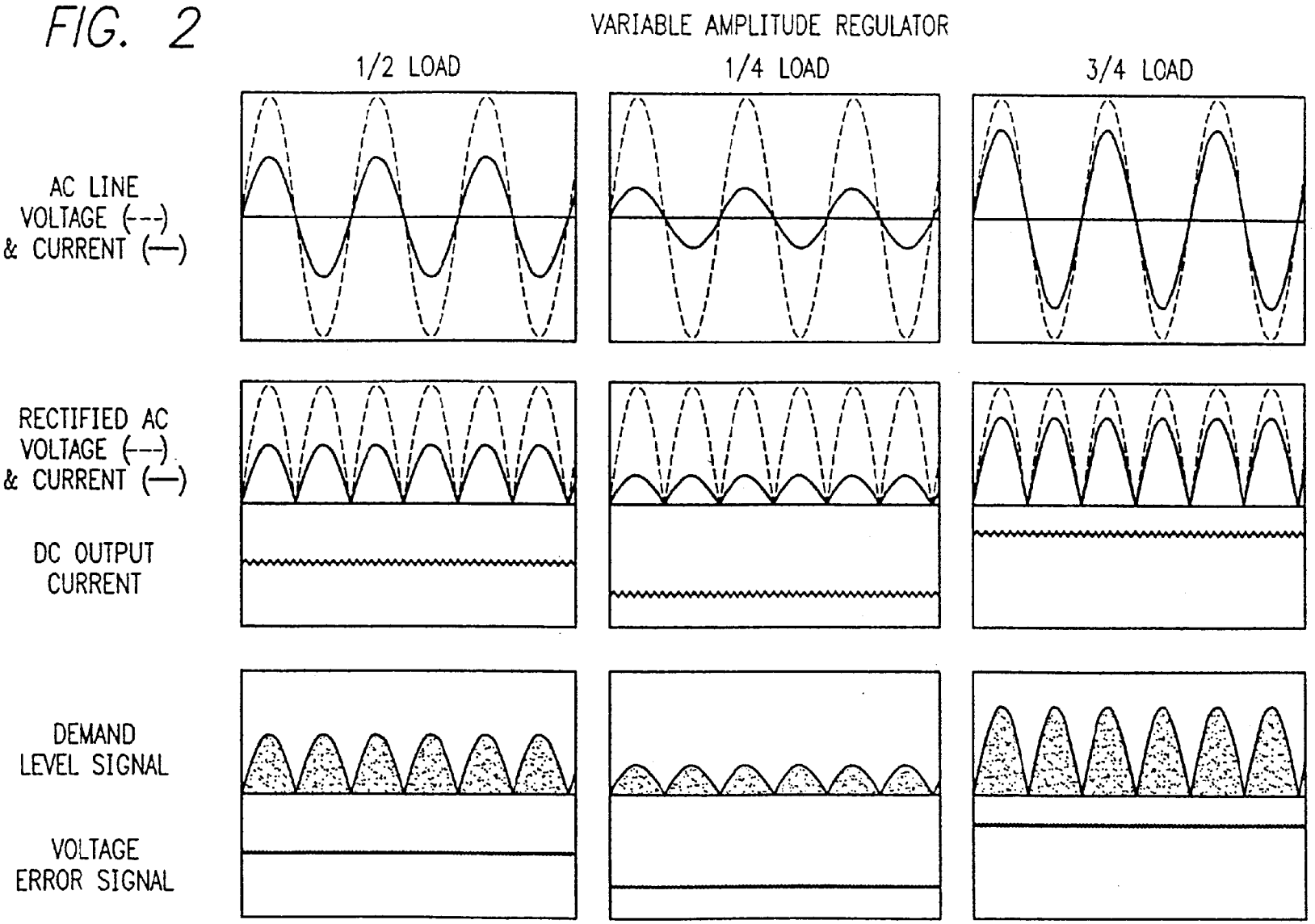
FIG. 2 illustrates waveforms useful in understanding the operation of the system shown in FIG. 1.

The VAR interface causes the waveform of the current in the power inductor 28 to be congruent and in phase with the rectified AC input voltaic (ACR), as indicated in FIG. 2. At the same time, the lac RMS value must be regulated to maintain the DC output voltage for various changing load conditions. Load variations are detected by a voltage error differential amplifier 44, which produces a voltage error signal VES on the line 45. This signal is produced by comparing the output DC voltage on the load terminal 27, as it appears across a resistor divider consisting of the resistor 46 and the resistor 48 coupled to one input of the amplifier 44 against a fixed reference provided across the Zener diode 52 connected to the other input of the amplifier 44. The filter capacitor 50 also is connected across the DC output, as is readily apparent from FIG. 1.

Whenever changes occur in the direct current load connected across the positive direct current terminal 27 and the negative or return (RTN) terminal shown in FIG. 1, a corresponding change or variation occurs in the output of the amplifier 44 in the VES signal applied over the line 45. The VES control signal on the line 45 is supplied as one of two inputs to the variable amplitude regulator interface circuit (VAR) 42. The other input is the rectified AC voltage (ACR) obtained from a voltage divider consisting of the resistors 36 and 38 connected across the output terminals of the rectifier 22. The two signals are combined to produce the control signal DLS for operating the pulse width modulator 30, which in turn controls the conductivity of the FET transistor 24 for regulating the current flow through the power inductor 28, as described above.

As mentioned previously, in a power factor correction (PFC) application, it is desirable to change the RMS value of the current, but not the wave shape, to prevent harmonic distortion of the alternating input current applied at the terminal 10. Consequently, whenever the load connected to the terminal 27 changes, the system must both regulate the wave shape of the incoming alternating current signal on the terminals 10, as well as the changes in the DC load current, without much delay. By employing the VAR interface 42, which can respond to both slow changes of the DC load as well as stepped changes or rapid changes the switch-mode modulator 30, which controls the operation of the transistor 24, is allowed to run at frequencies as low as 25 Khz, in contrast to systems of the prior art which typically had a 80 Khz lower limit The VAR interface produces a single output, the demand level signal (DLS), which is used as a control input by the PWM in the power stage of the PFC. This single output serves two functions; correction of the AC current waveform and phase, and adjustment of the AC current amplitude in response to changes in load.

There are two inputs to the VAR interface, the AC rectified voltage (ACR), and voltage error signal (VES). The ACR is the out it of the bridge rectifier 22 through the resistor divider 36 and 38, and is used to control the waveform and phase of the AC input current The VES is the output of the differential amplifier 44, and is used to control the average value of the AC input current.

The VAR interface design is based on a simple concept using a variable resistor ratio to control the amplitude of the signal (acrx) derived from the rectified AC input voltage (ACR). This control arrangement is illustrated in a simplified circuit diagram shown in FIG. 3. The relationship between the ACR and the DLS is defined by the following equation:

$$DLS = \left(\frac{R2}{R1 + R2}\right) \times \left(1 + \frac{R4}{R3}\right) \times ACR$$

In a typical application, the VES is connected to the terminal 45 to control the variable resistor 64. A resistor 80 and a capacitor 82 form a low pass filter to block AC line frequency ripple, from causing harmonic distortion. A resistor divider consisting of a resistor 62 (R1) and a variable resistor 64 (R2) produce a reduced ACR voltage which is connected to the (+) input of a differential amplifier 68. The amplifier 68 is used as an impedance buffer and a fixed gain stage as determined by the values of resistors 70 (R3) and 72 (R4). The output of the amplifier 68 connects to the terminal 32, the demand level signal (DLS). Based on the circuit configuration shown in FIG. 3, it is obvious that a change in the resistance of variable resistor 64 (R2) produces a proportional change in the demand level signal (DLS). The voltage error signal 45 (VES) controls the value of the variable resistor 64 (R2), which in turn controls the input of the amplifier 68. The output of the amplifier 68 is the demand level signal (DLS) on terminal or line 32. The circuit of FIG. 3 also includes a feedback resistor 72 and a filter capacitor 74, interconnected in a conventional manner.

Figure 3:
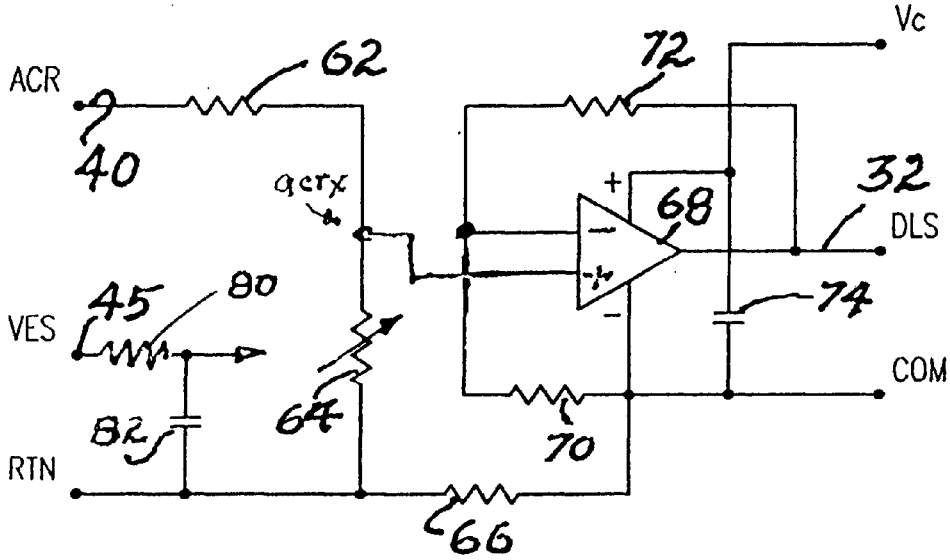
FIG. 3 is a simplified schematic diagram of a resistor scaling network useful in explaining the operation of the preferred embodiment of the invention.

In the simplified circuit of FIG. 3, it is apparent that the VAR interface which is illustrated produces a demand level signal (DLS) on the line 32, which satisfies both of the desired control functions of regulating the RMS value and maintaining the sinusoidal waveform in the current of the inductor 28. This is accomplished by combining the two input signals ACR and VES on the terminals 40 and 45, respectively. Because the value of the resistor 64 may be varied, the value of the DLS output on the line 32 is variable. By dynamically controlling the resistivity of the resistor R2, the variation in the DLS signal on the line 32 effectively may be utilized to control the PWM 30 of FIG. 1 to maintain the output voltage steady as the load changes, and to keep the input current in phase and congruent with the AC line voltage applied across the terminals 10.

Figure 4:
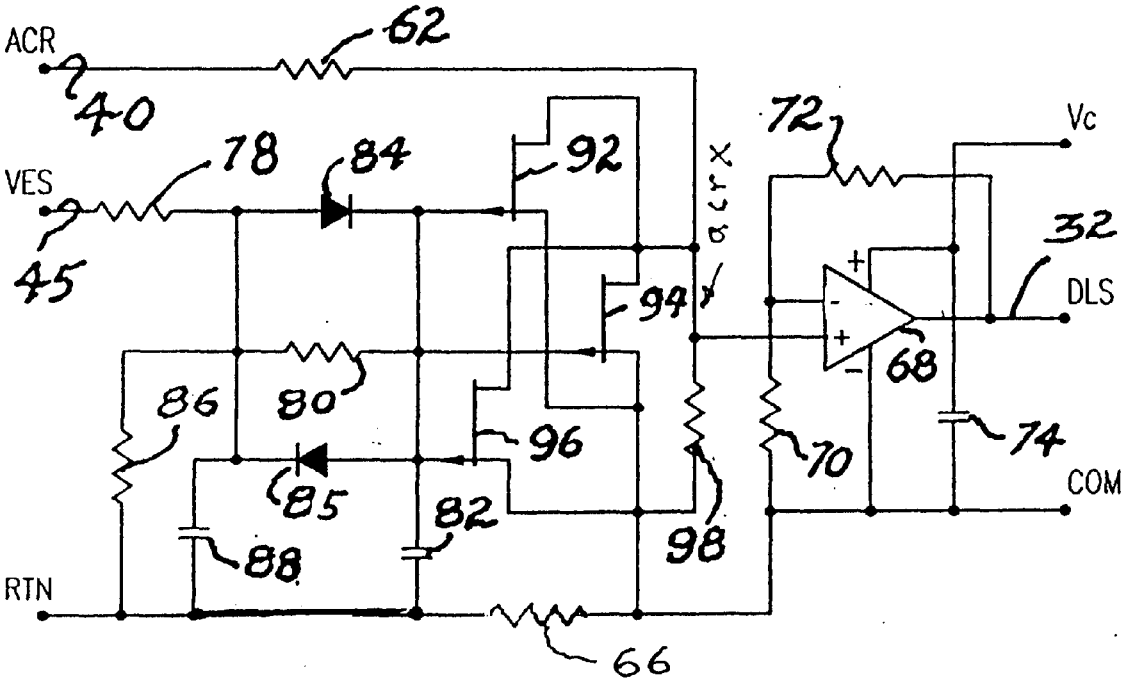
FIG. 4 is a detailed schematic diagram of the preferred embodiment of the invention.

Reference now should be made to FIG. 4, which is a detailed schematic diagram of the VAR circuit 42 of a preferred embodiment of the invention. The circuit of FIG. 4 is the specific implementation of an actual configuration of the resistor scaling network described generally in conjunction with FIG. 3.

In the circuit of FIG. 4, the ACR signal is applied on the terminal 40; and the VES signal is applied on the lead 45, as in the case of the circuit of FIG. 3. The input return signal is shown at the bottom of FIG. 4 as RTN. The output differential amplifier 68 is illustrated providing the DLS output on the line 32, and is shown with the feedback resistor 72 connected in series with the resistor 70 to provide gain to the differential amplifier 68. The input obtained from the scaling circuit is supplied to the + terminal of the amplifier 68.

As shown in FIG. 4, the ACR signal on terminal 40 connects through the resistor 62 to the drains of three identical JFETs 92, 94, and 96. These JFET devices are connected in parallel with each other and function as a voltage controlled variable resistance. Many different field effect transistor (FET) types are available and can be used;

however, the VAR circuit schematic illustrated in FIG. 4 is designed to incorporate a type J175. The voltage error signal (VES) applied at terminal 45 provides the control for regulating the resistance of the three JFETs, 92, 94 and 96. The frequency response of the VAR interface is tailored to accommodate three basic requirements: low harmonic distortion, fast reaction to sudden changes in AC input voltage, and fast reaction to sudden changes in DC output (load) current.

In order to achieve low harmonic distortion and a power factor of 0.99 or better, it is necessary to insert a low pass filter between the VES terminal 45 and the gates of the three JFET devices 92, 94 and 96. This filter is necessary to block the AC line frequency ripple, which is superimposed on the voltage error signal (VES). The AC line frequency ripple occurs in PFC circuits because the AC input current is cyclical and the DC current is nearly constant during steady state operation. In this implementation, the filter consists of a network of seven components, namely resistors 78, 80 and 86; capacitors 82 and 88; and diodes 84 and 85. The selection of each component is based on specific functional requirements. Resistors 78 and 86, and capacitor 88 are chosen to form a high frequency attenuator which reduces switching noise in the VAR interface. Resistor 80 and capacitor 82 form a low pass filter to block the AC line frequency ripple to achieve low harmonic distortion.

The gates of the transistors 92, 94 and 96 are connected in common to a filter network which includes resistors 78 and 86 and a capacitor 88 connected between the VES input terminal 45 and RTN. A resistor 80, having a high value of resistance (typically on the order of 100 k Ohm), in conjunction with a capacitor 82, operates as an input filter having an RC time constant which preferably is 100 ms or longer than the time constant provided by the filter including the resistor 86 and the capacitor 88. This time constant assures a very constant gate control voltage on the gates the JFETS 92, 94 and 96 for steady state or slow variations of the control signal VES o n the terminal 45.

To provide a faster response during step load or rapid load changes, a pair of opposite conductivity diodes 84 and 85 are connected in parallel to bypass the resistor 80. The forward voltage drop of these diodes is approximately 0.6 Volts; so that VES level changes on the terminal 45 of 0.6 Volts or greater are propagated through the resistor 78 and the diodes 84 and 85 to the gates of JFETs 92, 94 and 96, with a time constant of 2 ms or less, since the resistor 80 essentially is out of the circuit for such greater magnitude step load changes. Small perturbations (less than +/−0.5 V) are attenuated by the large value of resistor 80 and capacitor 82. The acrx signal is connected to the (+) input of amplifier 68. This amplifier is configured as a voltage follower with gain, and provides the demand level signal 32 (DLS), which is a low impedance output. The amplifier gain is set by the values of the resistors 70 and 72, which can be selected to meet specific DLS output requirements.

By providing the two different time constants through the filter circuit at the gates of the transistors 92, 94 and 96 with different RC combinations, the system is allowed to accommodate a slow response for steady state and slow variations in the DC load, as well as a fast response for step load changes using the VAR interface circuit. It is important to note that the DLS output on the terminal 32 is congruent with the rectified AC line voltage (ACR) and that there is very little phase shift between the signals, as illustrated in the idealized waveforms of FIG. 2. These characteristics are significant because the DLS output is the control reference for the PWM 30, which in turn regulates the AC line input current by controlling the on/off duty ratio of the transistor 24, as described previously in conjunction with FIG. 1.

Phase shift and waveform irregularities contribute to harmonic distortion and reduced power factor, as is well known. By utilizing the dynamic control response of the circuit of FIG. 4, a simple and accurate analog control circuit is provided for utilization in a power factor correction application.

The foregoing description of the preferred embodiment of the invention is to be considered as illustrative and not limiting. Various changes and modifications will occur to those skilled in the art for performing substantially the same function, in substantially the same way, to achieve substantially the same result, without departing from the true scope of the invention as defined in the appended claims.

What is claimed is:

1. A variable amplitude voltage regulator for use in a power factor correction system including in combination:

a resistor scaling network consisting of at least one variable resistor R2 and three fixed resistors R1, R3 and R4;

a source of rectified alternating current input voltage (ACR) coupled to the resistor scaling network;

a voltage error differential amplifier coupled to the ACR and to a reference signal to produce a voltage error signal (VES); and means coupling the VES to the resistor scaling network along with the ACR, wherein the resistor scaling network produces a demand level control signal (DLS) in accordance with the following formula:

$$DLS = \left(\frac{R2}{R1 + R2}\right) \times \left(1 + \frac{R4}{R3}\right) \times ACR$$

wherein R2 varies as a function of the VES dc level.

2. The variable amplitude voltage regulator according to claim 1 wherein R2 comprises at lease one field effect transistor (FET) having a gate, a source and a drain, the source drain path of which constitutes the variable resistance R2 and is supplied with the ACR, and the gate of which is supplied with the signal VES.

3. The variable amplitude voltage regulator according to claim 2 further including an RC filter coupled to the gate of the FET.

4. The variable amplitude voltage regulator according to claim 3 wherein the basic time constant of the RC filter is at least 100 milliseconds.

5. The variable amplitude voltage regulator according to claim 4 further including parallel connected opposite conductivity diodes connected to shorten the time constant of the RC filter for sudden load changes.

6. The variable amplitude voltage regulator according to claim 5 wherein the diodes have a forward voltage drop of substantially 0.6 Volts causing the RC filter to be bypassed for step level changes in the error signal VES which exceed 0.6 Volts.

7. The variable amplitude voltage regulator according to claim 6 further including an output differential amplifier having first and second inputs, with the first input coupled to the drain of the FET and the second input coupled to a resistor divider controlling gain, and having an output comprising the signal DLS.

8. A variable amplitude voltage regulator according to claim 7 wherein the FET comprises a plurality of field effect transistors, the drain source paths of which are connected in parallel and the gates of which are connected to a common gate input terminal.

9. A variable amplitude voltage regulator according to claim 2 wherein the FET comprises a plurality of field effect transistors, the drain source paths of which are connected in parallel and the gates of which are connected to a common gate input terminal.

10. The variable amplitude voltage regulator according to claim 9 further including an RC filter coupled to the gate of the FET.

11. The variable amplitude voltage regulator according to claim 10 further including parallel connected opposite conductivity diodes connected to shorten the time constant of the RC filter for sudden load changes.

12. The variable amplitude voltage regulator according to claim 11 wherein the diodes have a forward voltage drop of substantially 0.6 Volts causing the RC filter to be bypassed for step level changes in the error signal VES which exceed 0.6 Volts.

13. The variable amplitude voltage regulator according to claim 2 further including an output differential amplifier having first and second inputs, with the first input coupled to the drain of the FET and the second input coupled to a resistor divider controlling gain, and having an output comprising the signal DLS.

14. The variable amplitude voltage regulator according to claim 13 further including an R filter coupled to the gate of the FET.

15. The variable amplitude voltage regulator according to claim 14 further including parallel connected opposite conductivity diodes connected to shorten the time constant of the RC filter for sudden load changes.

* * * * *